US010905931B2

(12) United States Patent
Chauvin et al.

(10) Patent No.: US 10,905,931 B2
(45) Date of Patent: Feb. 2, 2021

(54) BALL BAT WITH STITCHED COMPOSITE LAYERS

(71) Applicant: EASTON DIAMOND SPORTS, LLC, Thousand Oaks, CA (US)

(72) Inventors: Dewey Chauvin, Simi Valley, CA (US); Mick Kaplan, Taipei (TW); Ian Montgomery, Simi Valley, CA (US); Frederic St-Laurent, Oak Park, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 15/663,692

(22) Filed: Jul. 28, 2017

(65) Prior Publication Data

US 2019/0030407 A1 Jan. 31, 2019

(51) Int. Cl.

| | |
|---|---|
| ***A63B 59/50*** | (2015.01) |
| ***A63B 59/56*** | (2015.01) |
| *A63B 102/18* | (2015.01) |

(52) U.S. Cl.

CPC ..... *A63B 59/50* (2015.10); *A63B 59/56* (2015.10); *A63B 2102/18* (2015.10); *A63B 2102/182* (2015.10); *A63B 2209/02* (2013.01)

(58) Field of Classification Search

CPC ..... A63B 59/50; A63B 2102/18

USPC ..... 473/564, 567, 563, 561

See application file for complete search history.

(56) References Cited

U.S. PATENT DOCUMENTS

| | | | | |
|---|---|---|---|---|
| 5,419,553 | A | 5/1995 | Rodgors | |
| 5,624,115 | A | 4/1997 | Baum | |
| 6,152,840 | A | 11/2000 | Baum | |
| 6,776,735 | B1 * | 8/2004 | Belanger | B29C 70/32 473/567 |
| 8,029,391 | B2 | 10/2011 | McNamee et al. | |
| 9,295,890 | B2 | 3/2016 | Gans | |

(Continued)

OTHER PUBLICATIONS

Ellis Developments Limited, "Web Page—Through Stitching of Composites", available at http://www.ellisdev.co.uk/through_stitching.html, exact publication unknown, website visited Jul. 28, 2017, 2 pgs.

(Continued)

*Primary Examiner* — John E Simms, Jr.
*Assistant Examiner* — Rayshun K Peng
(74) *Attorney, Agent, or Firm* — Perkins Coie LLP

(57) ABSTRACT

A barrel of a ball bat may include a composite laminate with a plurality of composite plies. One or more translaminar elements may pass through the composite plies and around a circumference of the barrel to reduce relative movement between the plies. The translaminar elements may include a first line of stitching, which may include aramid fiber. In some embodiments, the first line of stitching forms two or more coils around the barrel. Lines of stitching may be positioned on opposing sides of a center of percussion of the ball bat. In some embodiments, the translaminar elements may include a line of staples distributed around the circumference of the barrel. A method of making a ball bat may include arranging plies of composite material to form a cylinder, passing a first translaminar element through the plies, and curing the assembly of plies to form a barrel of the ball bat.

20 Claims, 6 Drawing Sheets

(56) References Cited

U.S. PATENT DOCUMENTS

| | | | | |
|---|---|---|---|---|
| 2004/0198539 | A1* | 10/2004 | Sutherland | B29C 70/48 473/567 |
| 2004/0221712 | A1* | 11/2004 | Stewart | B32B 5/12 89/36.05 |
| 2014/0179469 | A1* | 6/2014 | Berggren | A63B 45/00 473/604 |
| 2017/0252617 | A1* | 9/2017 | Caron Kardos | B32B 5/245 |

OTHER PUBLICATIONS

Ellis Developments Limited, "Web Page—Through Stitching Z-Axis Stitching", available at http://www.ellisdev.co.uk/thezarc.html, exact publication date unknown, webpage visited Jul. 28, 2017, 2 pgs.

Sickinger, C. et al., "Structural Stitching as a Method to design High-Performance Composites in Future", Proc. TechTextil Symposium 2001, Messe Frankfurt, Frankfurt am Main, Germany, 10 pgs.

* cited by examiner

Z
X
100
150
230
230
230

BALL BAT WITH STITCHED COMPOSITE LAYERS

BACKGROUND

Baseball and softball governing bodies have imposed various bat performance limits over the years with the goal of regulating batted ball speeds. Each association generally independently develops various standards and methods to achieve a desired level of play.

During repeated use of bats made from composite materials, the matrix or resin of the composite material tends to crack, the fibers tend to stretch or break, and the composite layers or plies tend to delaminate or separate from each other. For example, delamination or separation of the plies may result from the bat being deflected beyond the interlaminar shear strength limits of the composite material. This break-in tends to reduce stiffness and increase the elasticity or trampoline effect of a bat against a ball, which tends to temporarily increase bat performance.

Some unscrupulous players choose to intentionally break in composite bats to increase performance. Intentional break-in processes may be referred to as accelerated break-in (ABI), and may include techniques such as "rolling" a bat or otherwise compressing it, or generating hard hits to the bat with an object other than a ball.

In some circumstances, a broken-in bat may temporarily exceed performance limitations specified by a governing body, such as limitations related to batted ball speed. Recent regulations require composite bats to comply with performance limitations regardless of whether they have been broken-in through normal use or through abuse.

SUMMARY

Representative embodiments of the present technology include a ball bat with a barrel having a composite laminate including a plurality of composite plies, the barrel further including one or more translaminar elements passing through the plurality of composite plies and positioned around a circumference of the barrel to reduce relative movement between the plies. The one or more translaminar elements may include a first line of stitching. In some embodiments, the first line of stitching includes aramid fiber. In some embodiments, the first line of stitching passes around the circumference of the barrel to form two or more coils around the barrel. The one or more translaminar elements may include a second line of stitching. In some embodiments, the first and second lines of stitching may be positioned on opposing sides of a center of percussion of the ball bat along a longitudinal axis of the ball bat. In some embodiments, the one or more translaminar elements may include a line of staples distributed around the circumference of the barrel. The composite laminate may include at least one of carbon fibers or aramid fibers. The lines of stitching may be oriented at an oblique angle relative to a transverse plane passing through the barrel.

In a further representative embodiment of the present technology, a method of making a ball bat includes arranging two or more plies of composite material to form a cylinder, passing a first translaminar element through the two or more plies of composite material, and curing the two or more plies of composite material to form a barrel of the bat. Passing a first translaminar element through the two or more plies of composite material may include stitching a line connecting the two or more plies of composite material. The method may include stitching a line around the cylinder to form two or more coils around the cylinder. In some embodiments, a method of making a ball bat may include passing a second translaminar element through the two or more plies of composite material, the second translaminar element being positioned on an opposing side of a center of percussion of the ball bat relative to the first translaminar element. In some embodiments, the translaminar element may include one or more staples.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to ball bats with stitched composite layers, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as structures or functions common to ball bats and composite materials, methods of making composite materials, or systems and methods for stitching materials together, may not be shown or described in detail so as to avoid unnecessarily obscuring the relevant description of the various embodiments. Accordingly, embodiments of the present technology may include additional elements or exclude some of the elements described below with reference to FIGS. 1-5, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sporting good implements or in other sports or industries involving striking implements.

Figure 1:
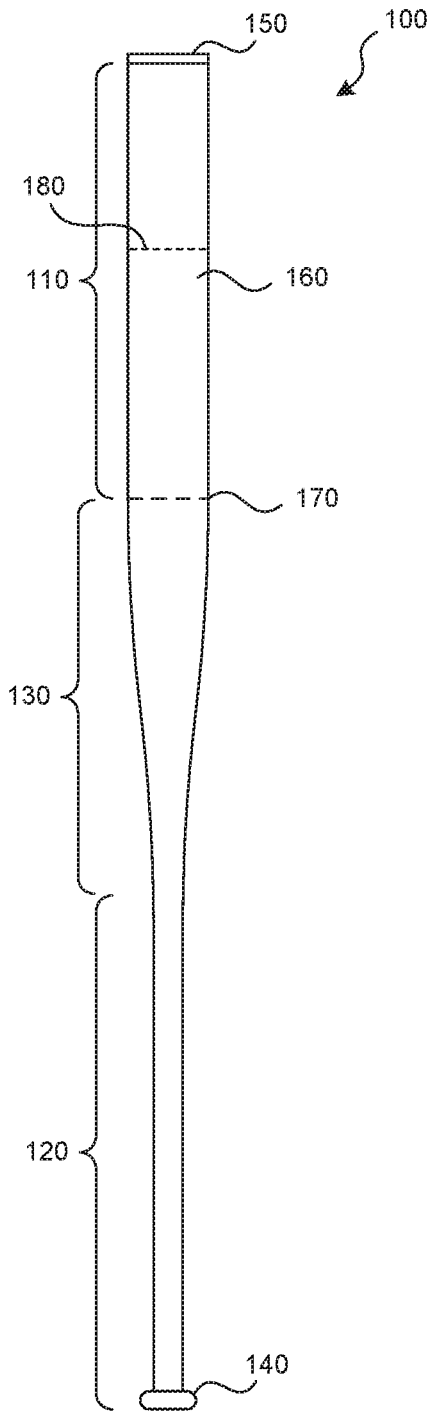
FIG. 1 illustrates a ball bat according to an embodiment of the present technology.

Turning now to the drawings, FIG. 1 illustrates a ball bat 100 having a barrel or barrel portion 110 and a handle or handle portion 120. There may be a transitional or taper portion 130 in which a larger diameter of the barrel portion 110 transitions to a narrower diameter of the handle portion 120. The handle portion 120 may include an end knob 140 and the barrel portion 110 may optionally be closed with an end cap 150. The barrel portion 110 may include a non-tapered or straight section 160 extending between the end cap 150 and an end location 170.

The bat 100 may have any suitable dimensions. For example, the bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly among users.

The barrel portion 110 may be constructed with one or more composite materials. Some examples of suitable composite materials include plies reinforced with fibers of carbon, glass, graphite, boron, aramid (such as Kevlar®), ceramic, or silica (such as Astroquartz®). Accordingly, in various embodiments, a number of different composite plies suitable for use in ball bats may be used, including, for example, composites formed from carbon fiber, fiberglass, aramid fibers, or other composite materials or combinations of matrices, resins, fibers, laminates, and meshes forming composite materials. In some embodiments, the barrel portion 110 may include layers or plies made of the same material (for example, each ply or layer may be formed from carbon fiber), while in further embodiments, the barrel portion 110 may include layers or plies made of multiple different materials (for example, one or more plies or layers may be formed with carbon fiber and one or more other plies or layers may be formed with fiberglass).

The handle portion 120 may be constructed from the same material as, or different materials than, the barrel portion 110. In a two-piece ball bat, for example, the handle portion 120 may be constructed from a composite material (the same or a different material than that used to construct the barrel portion 110), a metal material, or any other material suitable for use in a striking implement such as the bat 100.

A center of percussion 180 is located in the barrel portion 110. The center of percussion 180 is a location along the length of the bat 100 where some of the highest or maximum batted ball speeds can be achieved. The center of percussion 180 is generally located at or near the "sweet spot" of the ball bat 100, and it may be measured or located according to the ASTM F2398-11 Standard. For example, in some bats, the center of percussion 180 may be located between 5.75 inches and 6.25 inches from the end of the bat having the end cap 150 (such as 6 inches from the end), depending on the characteristics of the bat assembly, including the optional cap 150. Note that although the center of percussion 180 is described and illustrated at a location in FIG. 1 and other figures described herein, the actual center of percussion 180 may reside at another location.

Figure 2:
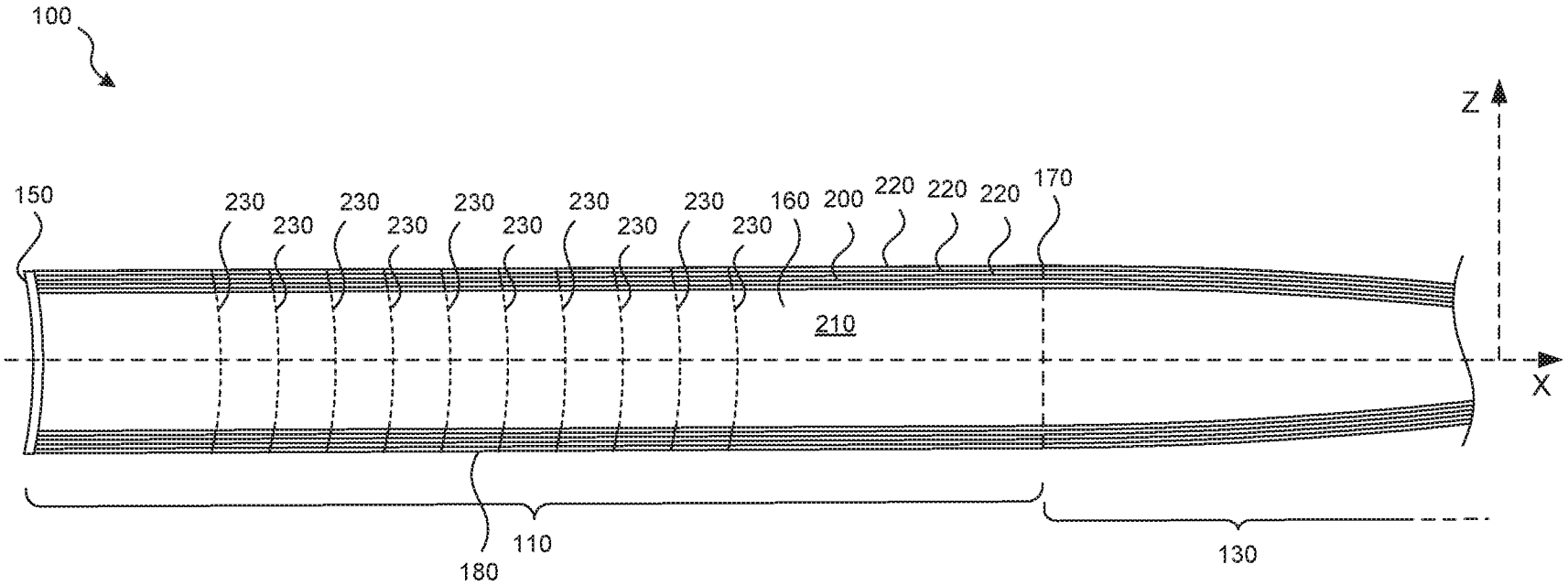
FIG. 2 illustrates a cross-sectional view of a portion of the ball bat illustrated in FIG. 1.

FIG. 2 illustrates a cross-sectional view of the barrel portion 110 of the ball bat 100, the straight section 160 of the barrel portion 110, the optional end cap 150, and a portion of the transitional or taper portion 130. The longitudinal axis x and a first transverse axis z of the ball bat 100 are illustrated. The bat 100 includes at least one barrel wall 200 defining an outer structure of the bat 100, which may have a hollow interior 210 in some embodiments. In some embodiments, the bat 100 may include structural elements inside the interior 210 or elsewhere in the bat 100.

The barrel wall 200 may be formed from a plurality of plies 220 of composite material, such as the composite materials described above. For example, the barrel wall 200 may include between two to seven plies, such as five plies, or even more plies depending on the thickness of the plies, the materials used in each ply, and the desired structural qualities of the assembled bat 100. The plies 220 may include layers of pre-impregnated ("pre-preg") material that may be stacked around a bat-shaped mold and cured into their final shape. The plies may also be cured together in a resin-transfer-molding process known to those of ordinary skill in the art. Layering composite plies into a bat shape (sometimes known as a preform) and then curing the preform is known to those of ordinary skill in the art.

According to embodiments of the present technology, one or more lines 230 of translaminar elements, such as translaminar stitching, are routed through the plies 220 forming the barrel wall 200 before curing the preform. The plies 220 are stitched together about all or a portion of the circumference of the barrel wall 200. Stitching the plies 220 of the preform before curing increases the cured bat barrel's resistance to delamination, thereby reducing or preventing an increase of the bat-ball coefficient of restitution (BBCOR) as the bat 100 breaks in during normal use or even during abuse.

The inventors tested both unstitched control bats and stitched bats according to embodiments of the present technology. Both types of bats (unstitched and stitched) underwent an ABI process (rolling) to damage the bats. Specifically, both types of bats were rolled to cause them to sustain equivalent decreases in compression (stiffness), such as five percent or ten percent of the original compression value (depending on the sport). The inventors discovered that the unstitched control bats exhibited more delamination than the stitched bats after the ABI process. The additional delamination in the unstitched control bats resulted in larger increases in BBCOR (performance) that could cause the bat to fail a regulatory body's performance test. In contrast, the stitched configurations exhibited smaller increases in BBCOR. In one stitched bat, the BBCOR value actually decreased after the ABI process. Accordingly, the inventors discovered that stitching according to embodiments of the present technology reduced or even eliminated the increase in BBCOR relative to bats without stitching.

Although ten lines 230 of stitching are illustrated in FIG. 2, any suitable number of stitch lines 230 may be used. For example, in some embodiments, there may be one line 230 of stitching, or in other embodiments, there may be 20, 30, or more stitch lines 230, depending on the desired strength of the barrel wall 200 or the materials forming the plies 220 or the stitch lines 230. In some embodiments, stitch lines 230 need not be separate lines. Rather, in some embodiments, a single line 230 of stitching may pass around the circumference of the barrel wall 200 multiple times in a spiral or helical pattern. In such embodiments, stitch lines 230 may be coils of a single line of continuous stitching that wraps around the circumference of the barrel wall 200 two or more times. In some embodiments, lines 230 or coils of stitching may be parallel to each other. In other embodiments, lines 230 or coils of stitching may be oriented at varying angles relative to each other.

The lines 230 of stitching may include threads or fibers of various materials or combinations of materials. In a particular embodiment, the threads or fibers have high strength and low stretching or elongation properties. For example, in some embodiments, the stitching may include threads or fibers of aramid (such as Kevlar®). In other embodiments, other threads or fibers may be used, such as nylon, polyester (such as Mylar®), cotton, cotton/polyester blends, linen, rayon, silk, carbon fibers, wool, glass fiber, or other fibers.

Figure 3:
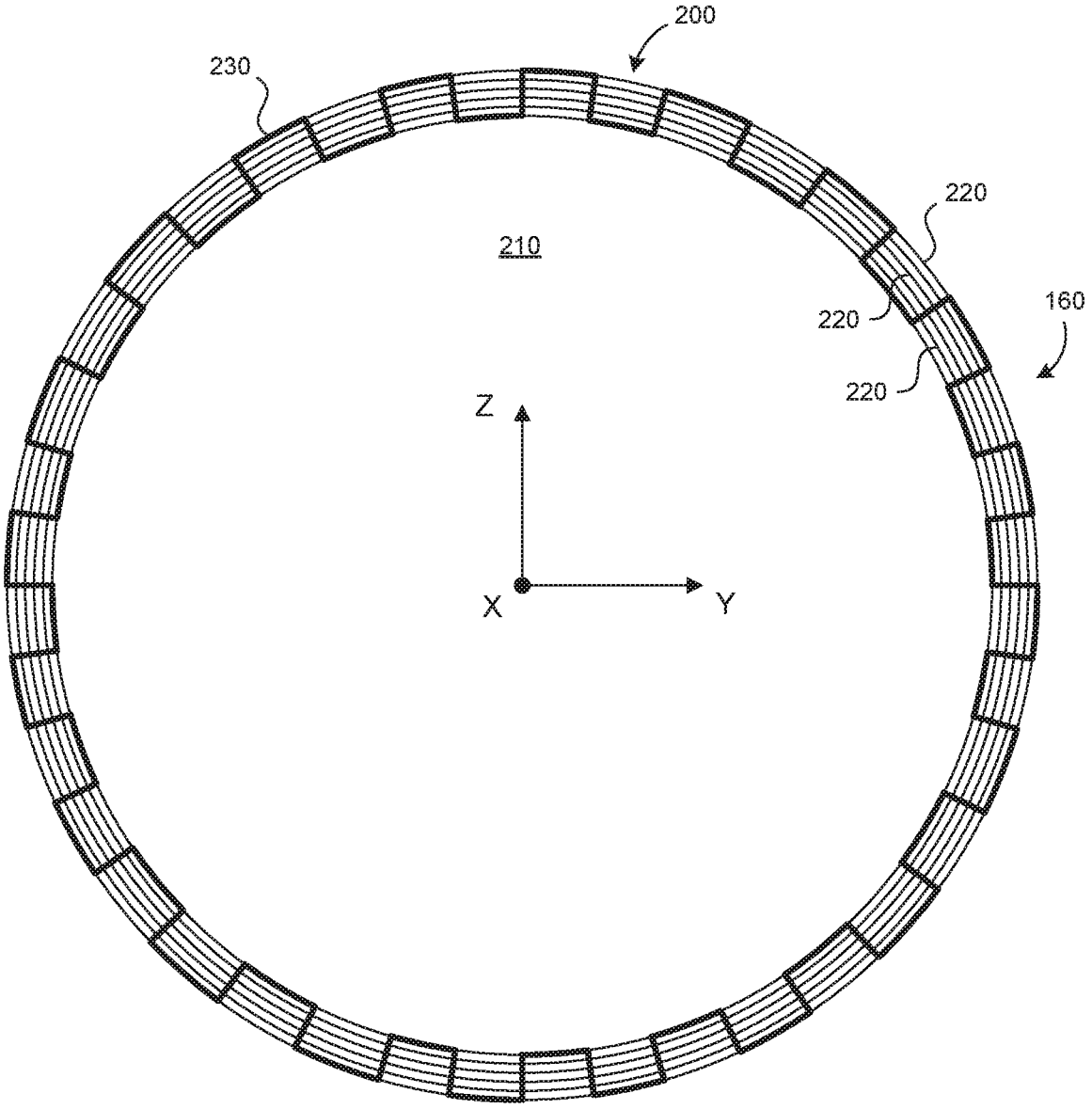
FIG. 3 illustrates a cross-sectional view of a barrel portion of a ball bat having a line of stitching through the plies forming the barrel wall according to an embodiment of the present technology.

FIG. 3 illustrates a cross-sectional view of a portion of the straight section 160 of the barrel portion 110 having a line 230 of stitching passing through the plies 220 forming the barrel wall 200. The view in FIG. 3 is in the transverse plane formed by the first transverse axis z and a second transverse axis y of the bat. The longitudinal axis x of the bat extends perpendicularly to the transverse planes. The line 230 of stitching is illustrated as a straight stitch joining all the plies 220 together around the circumference of the barrel wall 200. In other embodiments, other stitching techniques may be used, such as cross-stitching or other stitching techniques for joining materials together.

Zig-zag stitching, for example, may offer support and strength over a wider area than straight stitching (for example, a zig-zag stitch may create an approximately one-quarter-inch seam area). Some stitch patterns may be implemented that allow some stretching before the stitch breaks. In some embodiments, a locking stitch may be used, in which the stitch binds itself so that a break in one stitch loop does not cause unraveling of the remaining stitches. The length of individual stitches is affected by speed and ease of manufacturing. For example, a short stitch length may make a seam stronger, but it will take longer to manufacture and there may be more holes in the composite, risking more broken fibers. In representative embodiments, individual stitches have lengths between 5 millimeters and 25 millimeters. Other suitable stitch lengths may be used.

Although FIG. 3 does not illustrate an end to the stitch, it is understood that the line 230 of stitching may be completed in a suitable manner, such as with a knot. In some embodiments, each line 230 of stitching traverses the full thickness of the barrel wall 200. In other embodiments, a stitch line 230 may traverse only a partial thickness of the barrel wall 200.

The line 230 of stitches in FIG. 3 is illustrated as being generally within the plane formed by the first transverse axis z and the second transverse axis y (in a plane perpendicular to the longitudinal axis x). However, in some embodiments, one or more lines 230 of stitches may be positioned in a plane that is at an oblique angle relative to the plane formed by the first transverse axis z and the second transverse axis y or relative to the longitudinal axis x. A side view of such a bat with stitches oriented at an oblique angle may appear to have a helical or spiral stitching pattern.

Figure 3A:
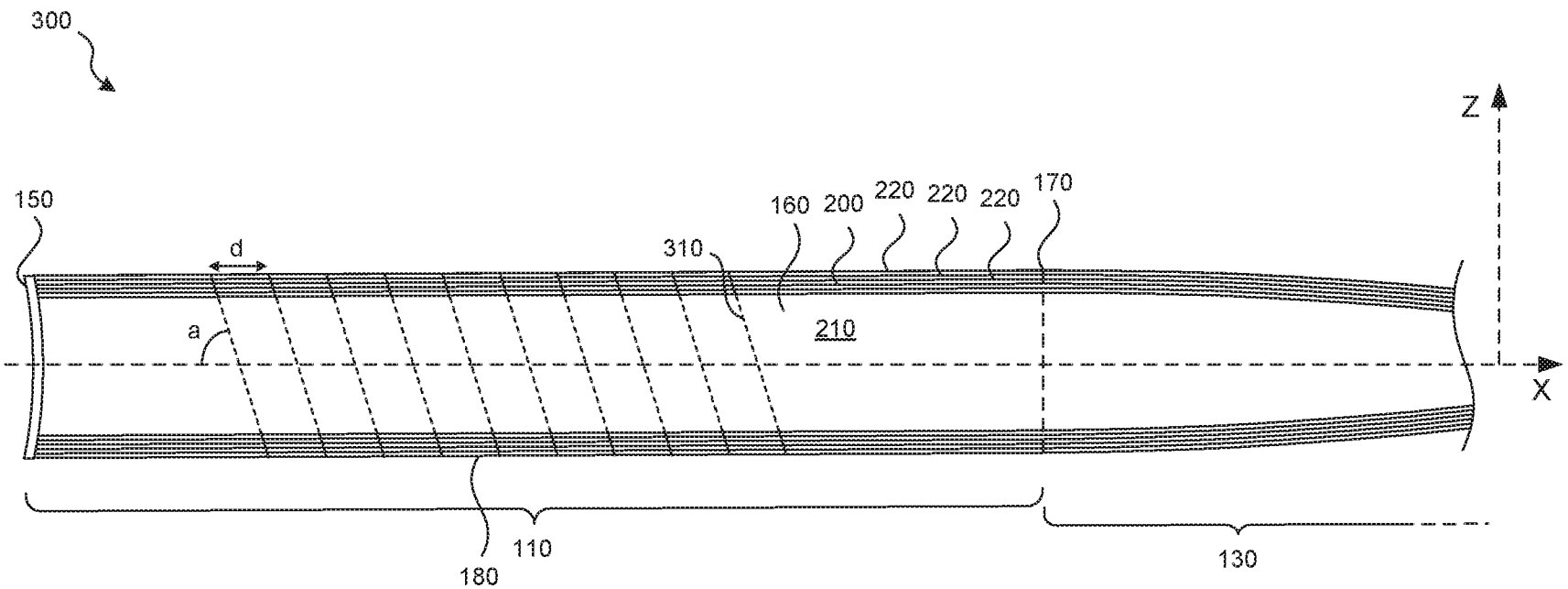
FIG. 3A illustrates a cross-sectional view of a portion of a ball bat according to an embodiment of the present technology.

For example, as shown in FIG. 3A, a ball bat 300 according to an embodiment of the present technology may include a line 310 of stitching that is oriented at an angle a relative to the longitudinal axis x. The line 310 of stitching may be continuous in some embodiments, or it may be broken into multiple lines 310 of stitching in other embodiments. By angling the line 310 of stitching, manufacturing may be simplified (the bat or the stitching equipment can be moved relative to the other while rotating the bat or stitching equipment to produce a spiral). The value of the angle a will also affect the density of stitching relative to the length along the longitudinal axis x (in other words, the axial distance between stitches). For example, if the line 310 of stitching is oriented at a 45 degree angle a relative to the longitudinal axis x, the seam will traverse along the longitudinal axis x by a distance of one circumference of the bat barrel as it completes a full revolution about the circumference. In some embodiments, the axial distance d between revolutions of the angled line 310 of stitching may be between 5 millimeters and 40 millimeters. In some embodiments, there may be 6 millimeters between seams, 4 stitches per inch along the longitudinal axis x, or other suitable dimensions.

Figure 4:
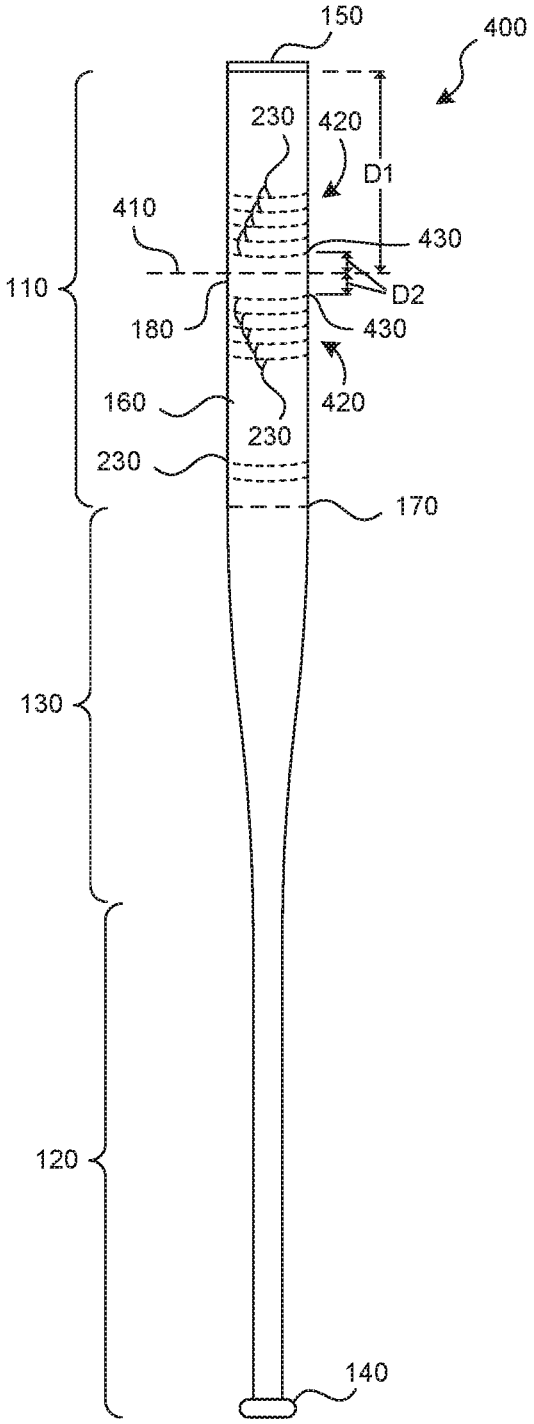
FIG. 4 illustrates a schematic side view of a ball bat having lines of stitching near a hit line of the ball bat according to an embodiment of the present technology.

The lines 230 of stitching (or the line or lines 310 of stitching, or other lines of stitching according to embodiments of the present technology) may be positioned at any suitable locations along the longitudinal axis x of the bat. In particular representative embodiments, the lines 230 of stitching are located in, near, or around a hitting zone of the ball bat. For example, FIG. 4 illustrates a schematic side view of a ball bat 400 having lines 230 of stitching near a hit line 410 of the ball bat 400 according to some embodiments of the present technology. The term "hit line" as used herein is understood to refer to a line generally around the circumference of the straight section 160 of the barrel portion 110 that serves as a reference point for distributing or positioning the lines 230 of stitching. For example, the hit line 410 may refer to the position on the bat corresponding to the center of percussion, the sweet spot, a maximum performance location (such as where maximum batted ball speeds are produced), or another location at which it is desirable to manage interlaminar failure as described herein. In general, the hit line 410 may be positioned within an area where the ball is intended to strike during use or play, or where a user may be inclined to perform an ABI process. In a particular representative embodiment, the hit line 410 may correspond to the centerline of a region of reduced durability, such as a region including a gap or discontinuity in the barrel laminate. In other embodiments, the hit line 410 may be positioned anywhere along the barrel portion 110.

In a particular representative embodiment of the present technology, the hit line 410 may be located at a distance from the center of percussion 180, such as between 0.5 inches and 1.5 inches from the center of percussion 180 in a direction towards the end cap 150 along the length of the bat 400 or towards the knob 140. In some embodiments, the hit line 410 may be a distance D1 from the end cap 150. The distance D1 may be between four inches and seven inches in some embodiments. In a particular representative embodiment, the distance D1 may be approximately six inches.

A group 420 of lines 230 of stitching (or one or more helical or spiral stitch lines 230 or 310 having one or more coils about the barrel portion 110) may be positioned on either side of the hit line 410 or on both sides of the hit line 410. Each group 420 may have between two and eight lines 230 of stitching, as illustrated in FIG. 4. Each group 420 may have a first line 430 of stitching that is positioned at a distance D2 from the hit line 410. The distance D2 may be between 0.1 inches and 3.5 inches in some embodiments. Each group 420 of lines 230 of stitching may be suitably dense to control delamination. For example, lines 230 of stitching in each group 420 may be between one and three millimeters apart from each other. In a particular representative embodiment, lines 230 of stitching (or each coil in a spiral pattern) in each group 420 may be approximately two millimeters apart. A high density of lines 230 of stitching near the hit line 410 helps prevent a stream of delamination from propagating away from the hit line 410. Each stitch in a line 230 may have a length (between adjacent holes in the composite material through which the stitch passes) of between three millimeters and twelve millimeters (such as five millimeters) and the stitching may be, but need not be, uniform or consistent.

In some embodiments, lines 230 of stitching may optionally be placed farther from the hit line 410 than described above. For example, one or more stitch lines 230 may be positioned at any location where delamination may occur between composite layers of the bat 400.

Lines of stitching according to embodiments of the present technology may be positioned and spaced apart as described herein, or they may be positioned and spaced apart at other suitable locations and by other suitable distances depending on the acceptable length of delamination between plies in a given bat wall, the strength of the thread, or the overall bat configuration, such as the overall strength or rigidity of a bat. For example, weaker or more flexible bats may require more lines of stitching placed closer together to each other. Stronger or less flexible bats may use fewer stitches or stitches placed farther from the hit line or spaced farther apart.

Figure 5:
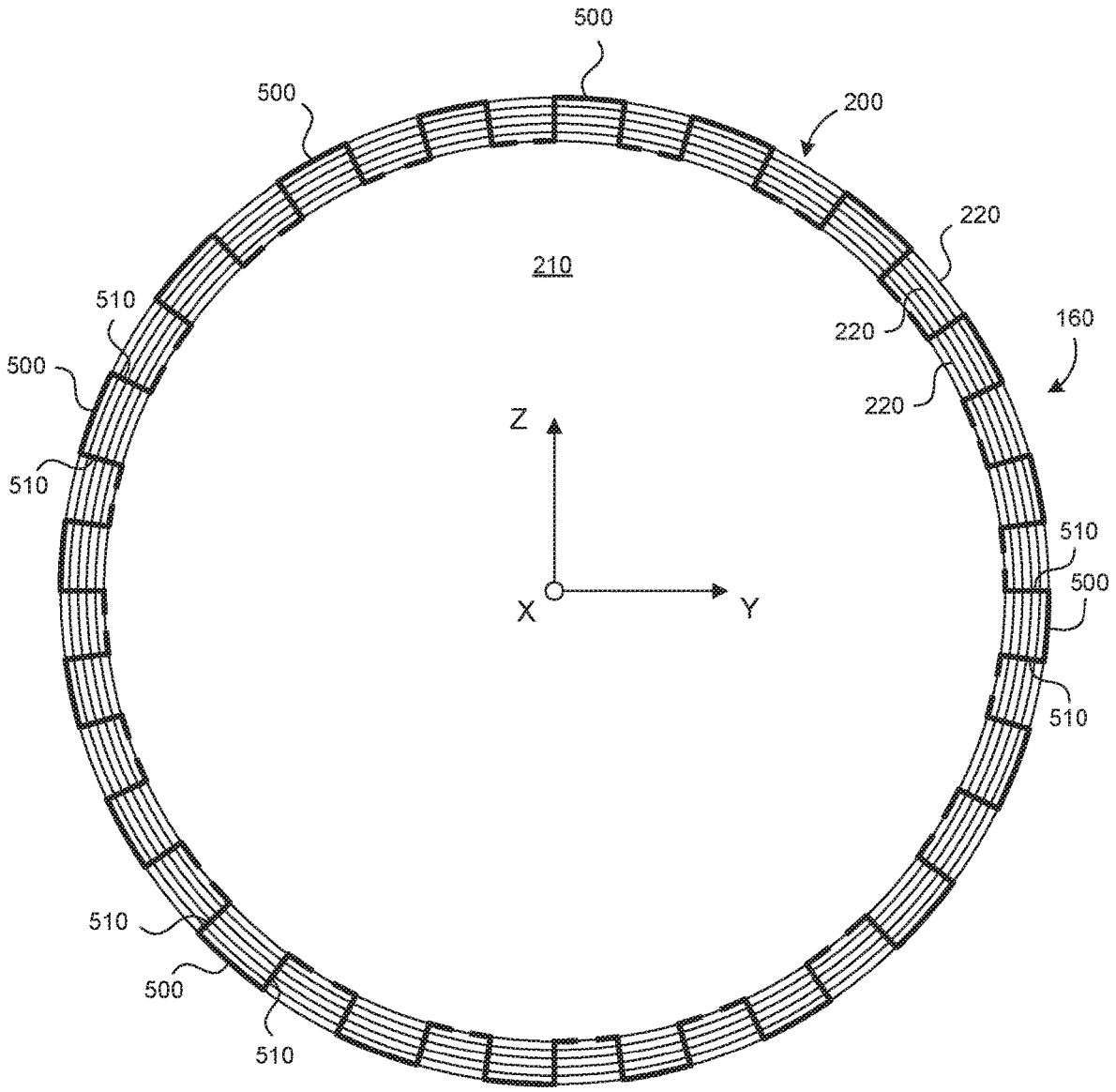
FIG. 5 illustrates a cross-sectional view of the barrel portion of a ball bat having a plurality of staples through the plies forming the barrel wall according to an embodiment of the present technology.

FIG. 5 illustrates a cross-sectional view of a portion of the straight section 160 of the barrel portion 110 having a line or a plurality of translaminar staples 500 through the plies 220 forming the barrel wall 200 according to an embodiment of the present technology. The staples 500 may be used in place of, or in addition to, the lines 230 of stitching described above (or lines 310, or other lines of stitching according to embodiments of the present technology). Staples 500 may allow some movement between plies 220 along the legs 510 of each staple while preventing or substantially preventing sliding movement between the plies 220. Staples may break structural fibers of the plies 220 more than stitching, so they may lower the tensile strength and stiffness of the overall composite barrel wall 200. One of ordinary skill in the art will be able to determine if the loss in stiffness or tensile strength outweighs the advantages of increased interlaminar shear strength when using staples in a given bat designed to comply with one or more standards.

In another embodiment of the present technology, a method of manufacturing a ball bat includes forming a composite preform by laying up plies (such as the plies 220 described above) in a cylindrical barrel form, followed by stitching or stapling the plies 220 together, followed by curing the assembly. In some embodiments, a sewing apparatus that has a small elongated end capable of reaching into the narrow interior of the bat preform may be used to stitch the plies 220 together. In some embodiments, plies of composite may be stitched or stapled together before forming the composite preform.

Ball bats according to embodiments of the present technology provide several advantages. For example, stitching or stapling resists or prevents sliding or other movement between plies of the composite laminate, which minimizes the elasticity or trampoline effect of a bat as it breaks in through use or abuse. In addition to increasing interlaminar strength, stitching or stapling according to various embodiments increases through-thickness strength or wall-strength of the barrel wall. Although stitching and stapling have been described and illustrated herein, other translaminar elements may be used to pass through the plies to prevent or reduce relative movement between them.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, although embodiments of the present technology are described as having stitches positioned relative to or centered around a hit line, the technology may be positioned in other locations along a ball bat, such as ball-impact locations where a user experiences minimum bat sensation when hitting the ball, or other suitable locations where impacts are expected or near where impacts may be expected, or areas of a bat that will undergo testing. Stitching or stapling need not be in a straight section of the ball bat. For example, stitching or stapling according to the present technology may be positioned in a tapered section of the bat. In some embodiments involving stitching, stitches need not be locked or fully tightened against the composite plies. For example, there may be a loose end or tuft extending into the interior of the ball bat. In some embodiments, an outer layer, laminate, covering, ply, or coating may be positioned over the translaminar elements (such as the lines of stitching or staples).

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat comprising a barrel with a composite laminate including a plurality of composite plies, the barrel extending along a longitudinal axis, the barrel further comprising:

a first line of stitching passing through holes in each ply of the plurality of composite plies and encircling the longitudinal axis; and a second line of stitching passing through holes in each ply of the plurality of composite plies and encircling the longitudinal axis;

wherein the first line of stitching is spaced apart from the second line of stitching along the longitudinal axis;

wherein a center of percussion of the ball bat is positioned between the first line of stitching and the second line of stitching along the longitudinal axis; and wherein the first line of stitching reduces relative movement between two or more plies of the plurality of composite plies.

2. The ball bat of claim 1 wherein the first line of stitching comprises aramid fiber.

3. The ball bat of claim 1 wherein the first line of stitching forms two or more coils of a spiral around the barrel, wherein the spiral extends along the longitudinal axis of the ball bat.

4. The ball bat of claim 1 further comprising a line of staples distributed around the circumference of the barrel.

5. The ball bat of claim 1 wherein the composite laminate comprises at least one of carbon fibers or aramid fibers.

6. A ball bat comprising:

a handle;

a barrel attached to or continuous with the handle along a longitudinal axis of the bat, the barrel comprising a plurality of composite plies forming a wall of the ball bat; and a first line of stitching passing through holes in the composite plies and around a circumference of the wall of the ball bat, the first line of stitching passing through all of the composite plies forming the wall of the ball bat.

7. The ball bat of claim 6 wherein the first line of stitching passes around the circumference of the wall of the ball bat to form two or more coils of a spiral extending along the longitudinal axis of the bat.

8. The ball bat of claim 6, further comprising a second line of stitching passing through the plurality of composite plies and around the circumference of the wall of the ball bat.

9. The ball bat of claim 8 wherein the first line of stitching and the second line of stitching are positioned on opposite sides of a center of percussion of the ball bat, along the longitudinal axis of the bat.

10. The ball bat of claim 6 wherein the first line of stitching comprises aramid fiber.

11. The ball bat of claim 6 wherein the first line of stitching is oriented at an oblique angle relative to a transverse plane passing through the barrel.

12. A ball bat comprising:

a handle;

a barrel attached to or continuous with the handle along a longitudinal axis of the bat, the barrel comprising a plurality of composite plies forming a wall of the ball bat; and a means for resisting delamination and reducing increases in bat-ball coefficient of restitution during use of the ball bat, wherein the means comprises one or more translaminar elements passing through a full thickness of the barrel wall including through holes in all of the composite plies in the plurality of composite plies, the one or more translaminar elements being positioned around a circumference of the barrel and configured to reduce relative movement between two or more plies of the plurality of composite plies.

13. The ball bat of claim 12 wherein the one or more translaminar elements comprises one or more staples.

14. The ball bat of claim 12 wherein the one or more translaminar elements comprises a line of stitching forming two or more coils of a spiral around the longitudinal axis of the bat and extending along the longitudinal axis of the bat.

15. The ball bat of claim 12 wherein the one or more translaminar elements comprises one or more lines of stitching encircling the longitudinal axis and oriented at an oblique angle relative to a transverse plane passing through the barrel.

16. The ball bat of claim 12 wherein the one or more translaminar elements comprise a first line of stitching and a second line of stitching, and wherein a center of percussion of the ball bat is positioned between the first line of stitching and the second line of stitching.

17. The ball bat of claim 12, further comprising an outer cover positioned over at least one of the one or more translaminar elements.

18. The ball bat of claim 1, further comprising an outer cover positioned over the first line of stitching and the second line of stitching.

19. The ball bat of claim 6 wherein the first line of stitching comprises a running stitch.

20. The ball bat of claim 6, further comprising an outer cover positioned over the first line of stitching.

* * * * *